United States Patent [19]

Horinchi

[11] Patent Number: 4,732,295

[45] Date of Patent: Mar. 22, 1988

[54] RECEPTACLE WITH SWINGING COVER

[75] Inventor: Yutaka Horinchi, Kitchener, Canada

[73] Assignee: Twin-Cee Limited, Georgetown, Canada

[21] Appl. No.: 3,261

[22] Filed: Jan. 14, 1987

[51] Int. Cl.[4] ..... B65D 43/14; B65D 51/04

[52] U.S. Cl. ..... 220/331; 220/1 T

[58] Field of Search ..... 220/1 T, 331

[56] References Cited

U.S. PATENT DOCUMENTS 3,384,385 5/1968 Cohen et al. ..... 220/331

*Primary Examiner*—George T. Hall

[57] ABSTRACT

The present invention provides a waste receptacle having a bin and a swinging cover mounted by a pair of support arms, one to each side of the bin. The cover, which is normally in a covering position, is movable to a bin cleaning position to either side of and still supported by the bin.

3 Claims, 8 Drawing Figures

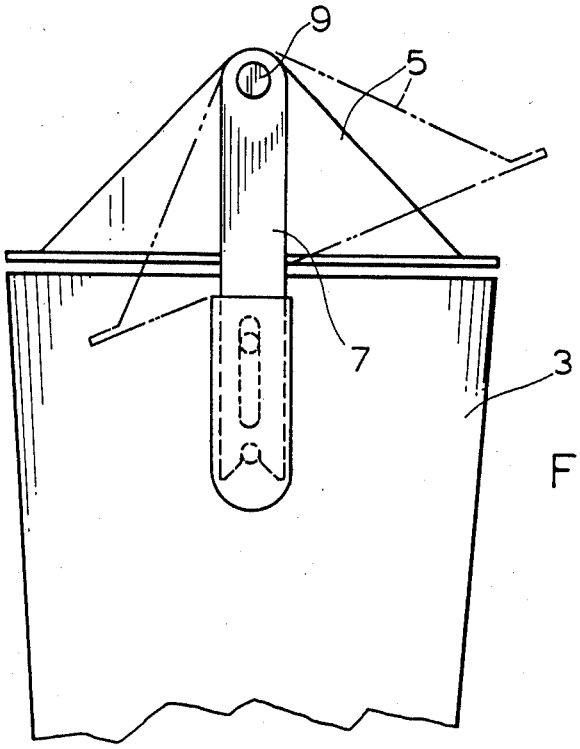
FIG. 3.
FIG. 4.
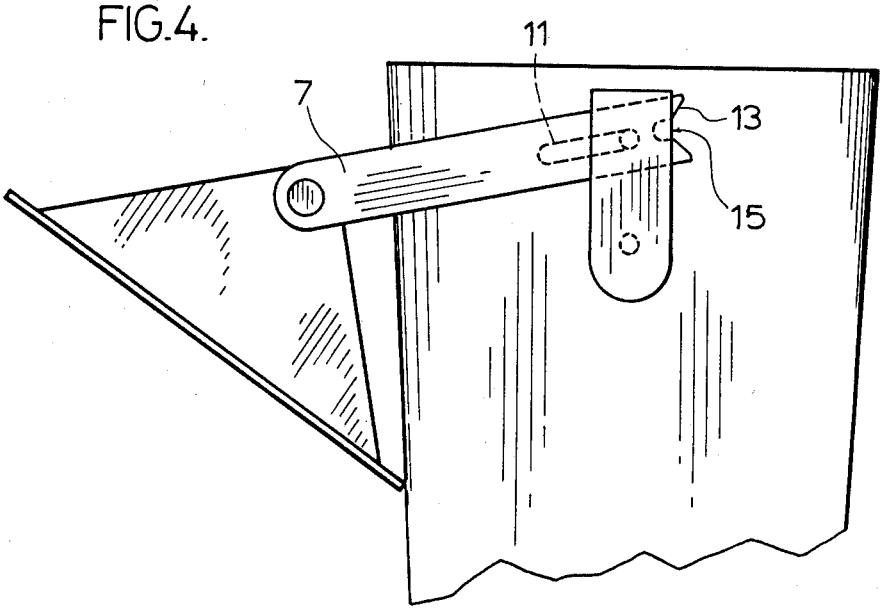

FIG.5.
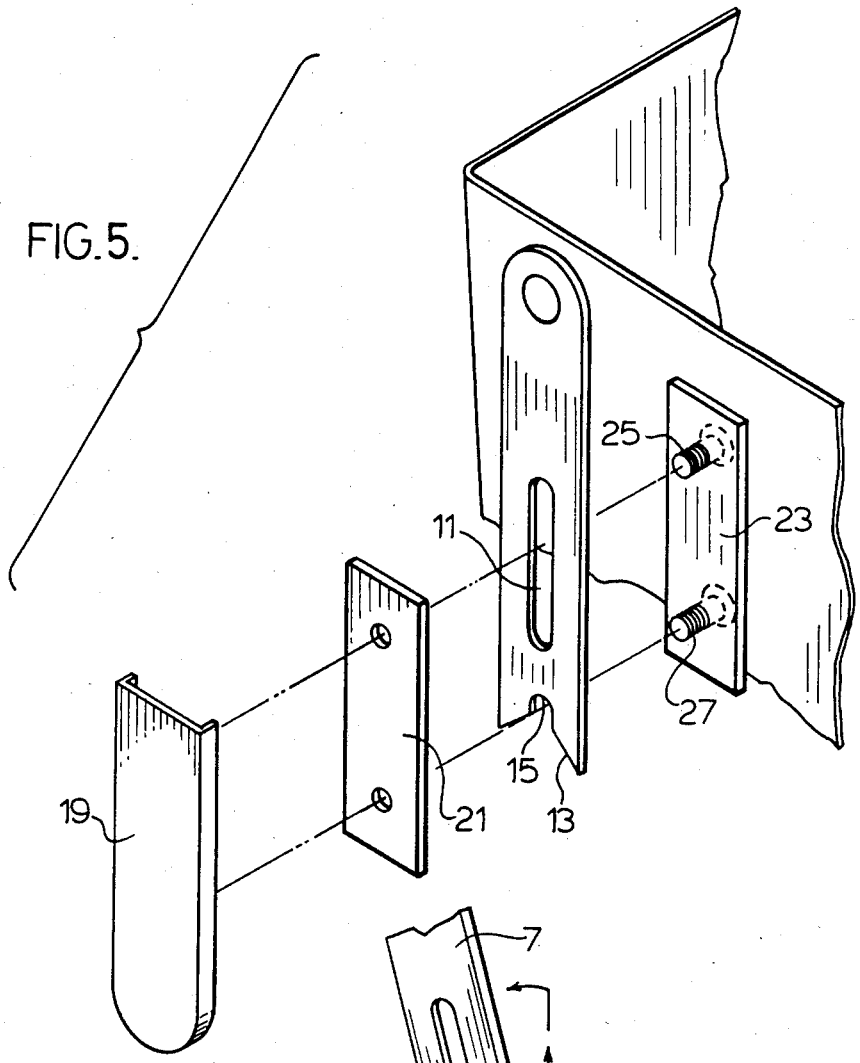
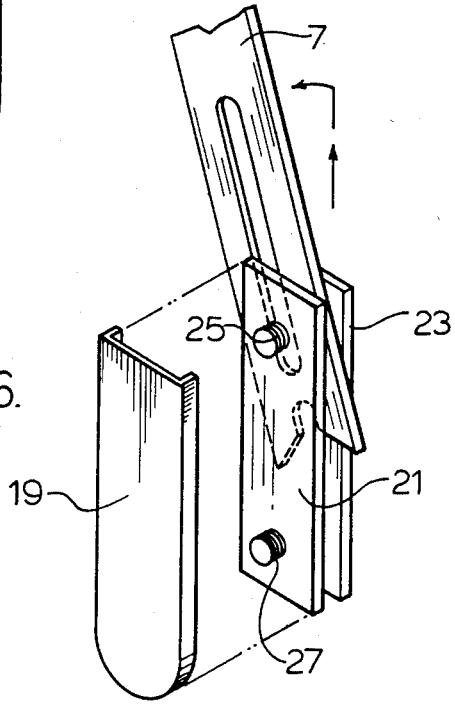
FIG.6.

RECEPTACLE WITH SWINGING COVER

FIELD OF THE INVENTION

The present invention relates to a waste receptacle of the type having a swinging head to allow the insertion of waste material into the receptacle.

BACKGROUND OF THE INVENTION

There are, presently available, many different types of waste receptacles. One such type is in the form of a bin having a head or cover which can be swung from side to side to place waste in the receptacle. The head or cover is mounted to the bin by a relatively heavy frame and in accordance with conventional construction, the entire assembly of the cover and the frame must be removed for cleaning the contents of the bin.

SUMMARY OF THE PRESENT INVENTION

The present invention provides a waste receptacle particularly designed to make the job of cleaning the bin much less awkward and strenuous than with conventional receptacles. More particularly, the present invention provides a waste receptacle comprising a lower bin and an upper swinging cover mounted by a pair of support arms to normally sit directly over the bin. However, for bin cleaning purposes, the support arms are movable, with the cover to either side of, while remaining supported by the bin. When the cover is in the bin cleaning position, it is not only located to one side of the bin, but it is also dropped to a level with or below the top of the bin providing easy access to the bin interior.

BRIEF DESCRIPTION OF THE DRAWINGS

The above, as well as other advantages and features of the present invention will be described in greater detail according to the preferred embodiments of the present invention in which:

FIGS. 3 and 4 are side views showing the movement of the cover from the FIG. 1 to the FIG. 2 position.

FIG. 5 is an exploded perspective view of the support arm mounting arrangement from the receptacle of FIGS. 1 through 4.

FIGS. 6 is an assembled view of the components shown in FIG. 5.

DETAILED DESCRIPTION ACCORDING TO THE PREFERRED EMBODIMENTS OF THE PRESENT INVENTION

Figure 1:
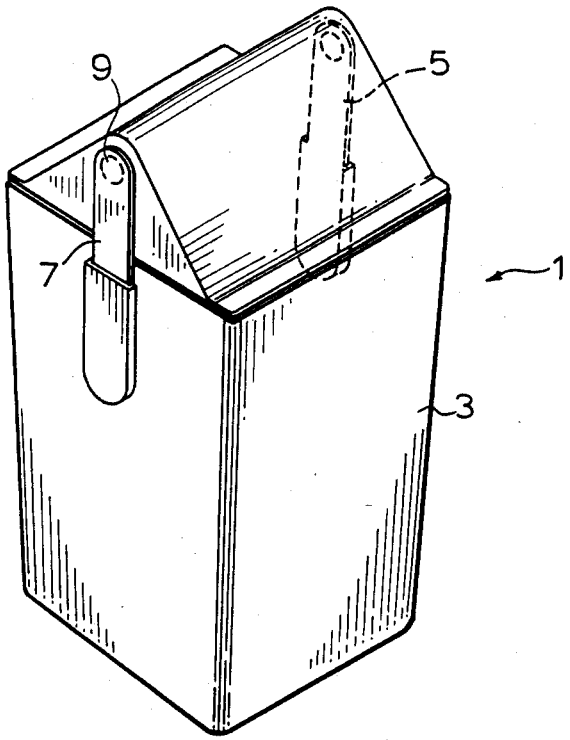
FIG. 1 is a perspective view of a waste receptacle according to a preferred embodiment of the present invention.

FIG. 1 shows a waste receptacle generally indicated at 1. This receptacle comprises a lower waste bin 3 and an upper cover 5. The cover is mounted to the bin by a pair of support arms 7, which in normal usage hold the cover directly over the bin. In FIG. 1, only one support arm can be seen. However, it is to be understood that the other side of the bin is set up in the identical manner.

Support arms 7, are secured by a pivotal connection 9 to the cover which allows it to swing back and forth, as shown in FIG. 3, for placing waste in the receptacle.

Figure 2:
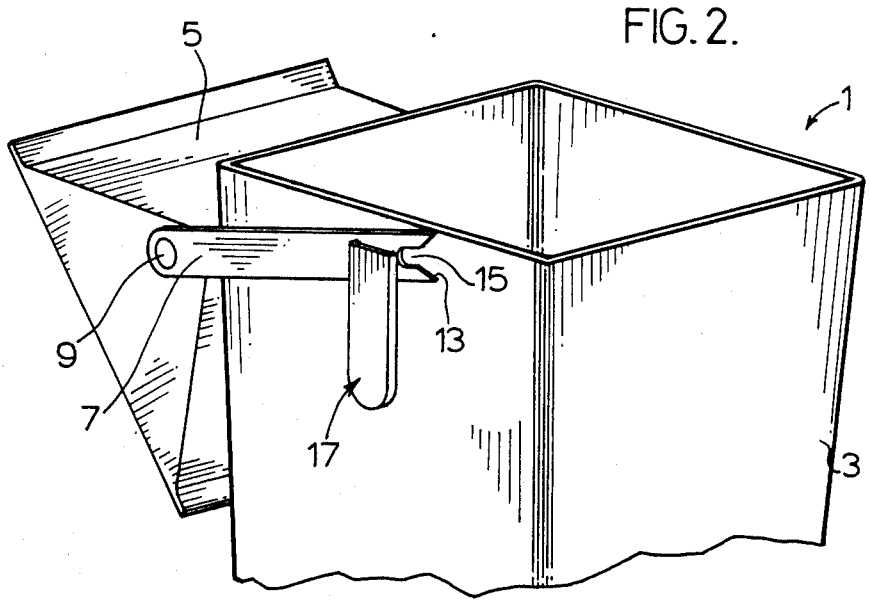
FIG. 2 is a further perspective view of the waste receptacle of FIG. 1 showing the cover in the bin cleaning position.

FIGS. 2 and 4 show the true crux of the invention where the support arms 7 can be pivoted to carry the cover 5 to either side of the receptacle for bin cleaning purposes while remaining connected to and supported by the bin. Therefore, the cover moves to a self stored position where, as can be seen in FIG. 4, it actually sits below the upper end of the bin completely out of the way for bin cleaning purposes. Furthermore, because the support arms are centrally mounted of the bin the cover can be stored to either side depending upon which side of the bin is accessible.

Here it should be noted that unlike prior art constructions and in accordance with the present invention there is nothing in the way of a mounting frame for mounting the cover to the bin and both the support arms and the cover itself are preferably made from light weight plastic material so that the entire structure is relatively light and easily moved to the self storing position with very little tipping or imbalancing load when sitting out to one side of the bin.

FIGS. 5 and 6 show, in detail, a mounting assembly generally indicated at 17 for mounting the support arms to the bin and the manner in which the support arms are movable between supporting positions. More particularly each of the support arms 7 includes a central elongated slot 11 fitted over a pair of threaded extensions 25 and 27 extending out from late 23 secured directly to the side of the bin. The threaded extensions 25 and 27 thread into plate 21 with arms 7 sandwiched between plates 21 and 23. Cap 19, which is for esthetic purposes only is then fitted over the two plates and the lower part of the arm.

When supporting cover 5 directly over the bin, the support arms extend vertically upwardly, as shown in FIG. 1. They are held in this upright position by means of extension or pin 27 which fits into a small blind ended recess 15 at the bottom of each of the support arms, as shown in FIG. 3 of the drawings. In order to move the support arms to the FIG. 4 position, they are simply lifted upwardly to clear their lower ends 13 off of pins 27 as seen in FIG. 6 and then rotate the arms about pins 25 to move them outwardly and downwardly to carry the cover down to the bin cleaning position. Here it should be noted that the two support arms are secured in relatively rigid positions with respect to one another by a cross bar extending across the cover. This insures that the two arms move substantially simultaneously free of jamming with a single left and rotate motion which is initiated by first swinging the cover to one side of the bin to provide a good grip for the lifting and moving of the cover.

After the bin has been cleaned, the cover is then moved back upwardly until the support arms assume a generally vertical position from which point they can then be lowered back onto pins 27. The alignment of recesses 15 with the lower pins is enhanced by bevelling the lower ends 13 of the arms to provide a guide for the fitting of the pins into the recesses as the arms are being lowered.

Figure 7:
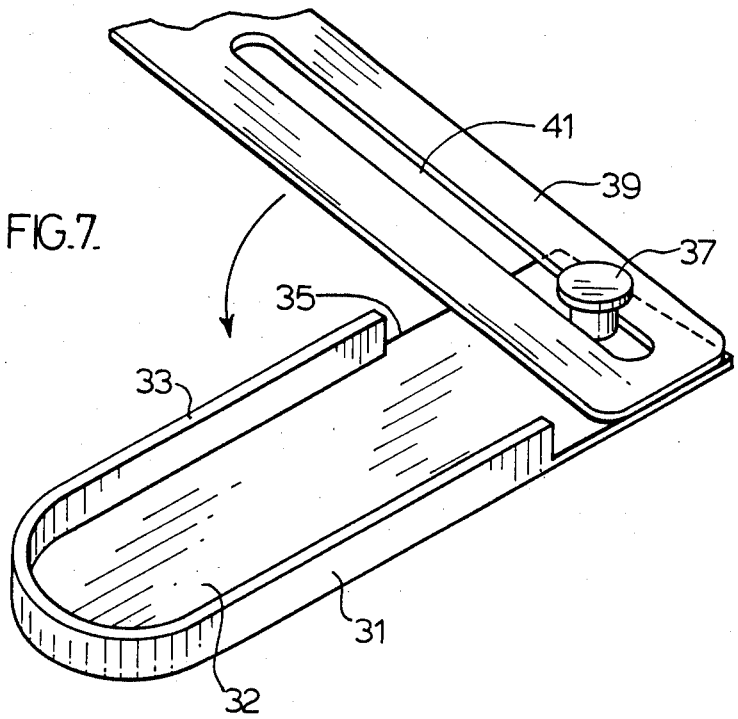
FIGS. 7 and 8 are perspective views of an alternate support arm arrangement from that shown in FIGS. 5 and 6.
Figure 8:
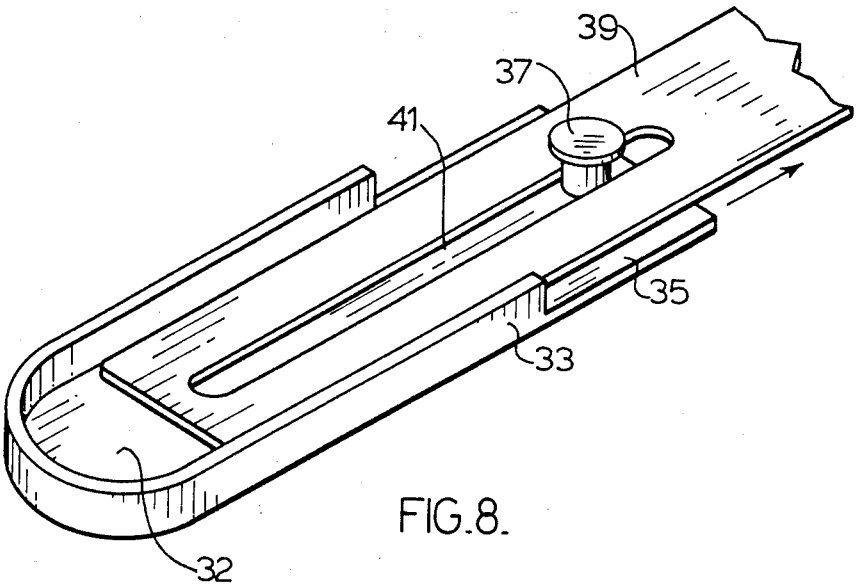

FIGS. 7 and 8 show an alternate mounting structure for the movable support arms. This mounting structure comprises a mounting bracket 31 including a flat plate portion 32 with a U-shaped upstanding wall 33 running around a major portion of plate 32. However, the upper part 35 of plate 32 is unwalled and includes a mounting pin 37 fitted within slot 41 of support arms 39.

FIG. 8 shows one of the support arms fitted within the support bracket so as to extend in its upright supporting position. Wall 33 traps the support arm against tipping away from its upright position.

In order to move the support arm, as shown in FIG. 7, it must be moved upwardly out of the walled region of the bracket as indicated by the arrow in FIG. 8 until the lower end of the support arm clears past wall 33 allowing the support arm to then be pivoted about pin 37, as shown in FIG. 7.

In still a further preferred embodiment of the present invention and not shown in the drawings, each of the support arms is again pivotally mounted directly to the bin. However, rather than using a physical restraining means to prevent the support arms from moving they are provided at their lower ends with biasing weights causing them to normally assume an upright position but also allowing them to be moved when pushed sideways to a bin cleaning position.

As will be apparent from the descriptions of all of the embodiments above, both the support arms and the cover are never detached from the bin and are self-storing in the bin cleaning position. This not only eases full access to the bin for cleaning purposes but also substantially eliminates tampering by theft.

Although various preferred embodiments of the invention have been described herein in detail, it will be appreciated by those skilled in the art that variations may be made without departing from the spirit of the invention or the scope of the appended claims.

The embodiments of the invention in which an exclusive property or privilege is claimed are defined as follows:

1. A waste receptacle comprising a bin and an upper swinging cover mounted by a pair of support arms to said bin, said support arms being movable from an upright position supporting said cover over said bin to a sideways extending position with said cover located to either side of said bin and including locking means for holding said support arms in said upright position, said support arms being slideable to clear away from said locking means for moving to the sideways extending position and being provided with elongated slots and mounted to said bin by a mounting structure comprising upper and lower pins fitted into said elongated slots, each support arm having a recessed lower end for fitting on the lower pin and being liftable to clear said recess from said lower pin and pivoting said support arms about said upper pins.

2. A waste receptacle comprising a bin and an upper swinging cover mounted by a pair of support arms to said bin, said support arms being movable from an upright position supporting said cover over said bin to a sideways extending position with said cover located to either side of said bin and locking means for holding said support arms in said upright position, said support arms being slideable to clear away from said locking means for moving to the sideways extending position with each of said support arms including an elongated slot and mounted to said bin by a support bracket, said support bracket comprising a plate portion having a lower region bordered by a upstanding wall and including a pivot pin on an upper unwalled region of said plate portion, said pivot pin being fitted through the elongated slot in each support arm and said walled region providing a guide for holding said support arm in the generally upright position with said support arms being liftable to clear from said walled region and pivot about said pivot pin to the sideways extending position.

3. A waste receptacle as claimed in claim 1 including a bevel guide to said recesses at the lower ends of said support arms.

* * * * *